United States Patent [19]

Allen et al.

[11] Patent Number: 4,719,973

[45] Date of Patent: Jan. 19, 1988

[54] FIRE AND EXPLOSION DETECTION AND SUPPRESSION

[75] Inventors: Nicholas S. Allen, Windsor; Peter E. Moore, Reading, both of England

[73] Assignee: Graviner Limited, Berkshire, England

[21] Appl. No.: 934,669

[22] Filed: Nov. 25, 1986

[30] Foreign Application Priority Data

Dec. 20, 1985 [GB] United Kingdom ..... 8531486

[51] Int. Cl.[4] ..... A62C 37/04

[52] U.S. Cl. ..... 169/61; 340/578; 169/23

[58] Field of Search ..... 340/578, 522; 244/114 R, 129.2; 169/60, 61, 23, 46, 47

[56] References Cited

U.S. PATENT DOCUMENTS

| | | | |
|---|---|---|---|
| 3,609,364 | 9/1971 | Paine et al. | 340/578 X |
| 3,716,717 | 2/1973 | Scheidweiler et al. | 340/578 X |
| 3,825,754 | 7/1974 | Cinzori et al. | 340/578 X |
| 4,280,058 | 7/1981 | Tar | 340/578 X |
| 4,401,976 | 8/1983 | Stadelmayr | 340/522 |
| 4,414,542 | 11/1983 | Farquhar et al. | 340/578 |
| 4,423,326 | 12/1983 | Ball | 340/578 X |
| 4,472,715 | 9/1984 | Kern et al. | 340/578 X |

FOREIGN PATENT DOCUMENTS

| | | | |
|---|---|---|---|
| 0080092 | 6/1983 | European Pat. Off. | 340/578 |
| 0159798 | 10/1985 | European Pat. Off. | 340/578 |
| 2079933 | 1/1982 | United Kingdom | 340/578 |
| 2142757 | 1/1985 | United Kingdom . | |
| 1013394 | 4/1983 | U.S.S.R. | 340/584 |

*Primary Examiner*—Jeffrey V. Nase
*Assistant Examiner*—James M. Kannofsky
*Attorney, Agent, or Firm*—Leydig, Voit & Mayer

[57] ABSTRACT

A fire and explosion detection and suppression system protects a hangar within which may be stored jet aircraft whose engines may be run up particularly in the re-heat mode. Two radiation sensors are mounted within the hangar and detect for at least predetermined amounts of radiation of predetermined and different types (e.g. one sensor may be a UV sensor and the other may be an IR sensor). When they simultaneously detect sufficient radiation, they operate an AND gate. This fires off suppressor units. To prevent false alarms due to radiation emitted by a running jet engine or a jet engine running in re-heat mode, such a running jet engine is sensed by a transducer responsive to the emitted acoustic or vibrational energy. This blocks the AND gate.

10 Claims, 4 Drawing Figures

FIRE AND EXPLOSION DETECTION AND SUPPRESSION

BACKGROUND OF THE INVENTION

The invention relates to fire and explosion detection and suppression. More specifically, the invention relates to fire and explosion detection and suppression systems and methods for detecting for fires and explosions in buildings, primarily hangars, where jet aircraft are stored.

SUMMARY OF THE INVENTION

According to the invention, there is provided a fire and explosion detection system, comprising radiation detection means operative to produce an alarm signal in response to detection of electromagnetic radiation indicative of a fire or explosion to be detected, and non-radiation-responsive transducer means operative to detect the existence within the area being protected of a source of electromagnetic radiation to which the radiation detection means is responsive but in response to which it is required not to produce an alarm signal, and inhibit means responsive to the transducer means for blocking the production of such alarm signal.

According to the invention, there is also provided a fire and explosion detection and suppression system, for protecting an area in which jet aircraft may be stored, comprising radiation detection means for detecting electromagnetic radiation arising from such fires and explosions within the said area and for producing a respective alarm signal, suppression means within the area and responsive to the alarm signal to discharge fire and explosion suppressant into the area, and transducer means responsive to the acoustic or vibrational energy emitted by a running jet engine for inhibiting the production of the said alarm signal.

According to the invention, there is further provided a fire and explosion detection and suppression method, for protecting an area in which jet aircraft may be stored, comprising the steps of detecting electromagnetic radiation arising from such fires and explosions within the said area and for producing a respective alarm signal, responding to the said alarm signal by discharging fire and explosion suppressant into the area, and responding to the acoustic or vibrational energy emitted from a running jet engine by inhibiting the production of the said alarm signal.

DESCRIPTION OF THE DRAWINGS

Fire and explosion detection and suppression systems and methods according to the invention will now be described, by way of example only, with reference to the accompanying diagrammatic drawings in which.

DESCRIPTION OF PREFERRED EMBODIMENTS

Figure 1:
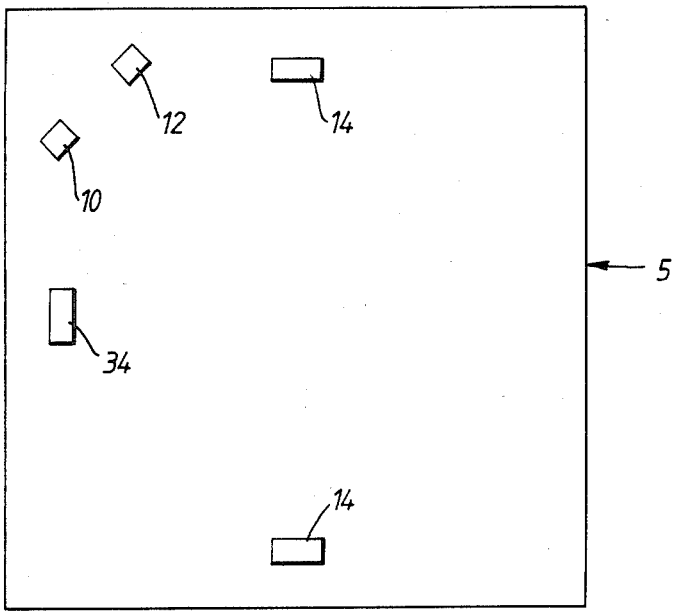
FIG. 1 is a diagrammatic view of a hangar to be protected by the system, showing sensors in one form of the system.

FIG. 1 shows a hangar 5 in which are stored jet aircraft and which is to be protected from fires or explosions. Within the hangar, two electromagnetic radiation sensors 10 and 12 are suitably mounted so as to be able to monitor substantially the whole of the area within the hangar and to detect radiation arising in it. The sensors are of a type which produces an electrical signal related to the electromagnetic radiation received.

The sensors may be of any suitable type. For example, they could both be responsive to infra-red radiation, possibly lying within different and predetermined wavelength bands. Instead, for example, one of the sensors could be sensitive to ultra-violet radiation and the other sensitive to infra-red radiation. Suitable infra-red radiation sensors are photo-diode type sensors or thermopiles. Suitable ultra-violet radiation sensors are gas discharge or solid state avalanche type sensors such as cold cathode gas discharge tubes. The sensors may be arranged to view the interior of the hangar through radiation filters having appropriate wavelength bands.

Figure 2:
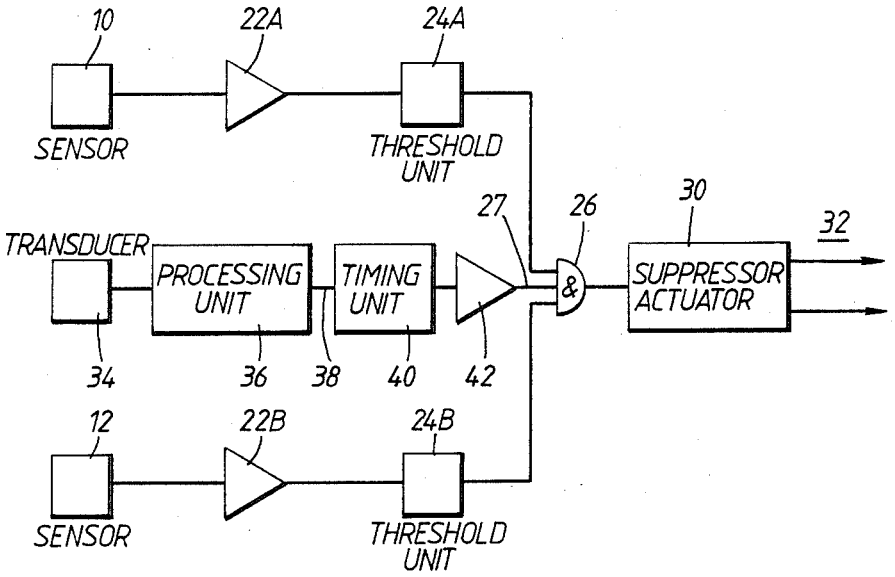
FIG. 2 is a block circuit diagram of the system to be described with reference to FIG. 1.

Within the hangar are mounted two (in this example) suppression units 14. They are positioned so as to be able to discharge suppressant over substantially the whole of the area of the hangar, this suppressant being of a suitable type (e.g. Halon) to extinguish the fires and explosions detected. In a manner to be explained, the suppression units 14 are activated, to discharge their suppressant, in response to operation of the sensors 10, 12. As shown in FIG. 2, the electrical output of sensor 10 is fed to an amplifying and processing unit 22A. This basically amplifies the signal from the sensor 10 but may also process it in a suitable way. If the sensor 10 is of the cold cathode gas discharge tube type, its operation will involve it "avalanching" in response to incidence of ultra-violet radiation above a certain leve, resulting in the emission of an electrical pulse. In such a case, the circuit unit 22A can be arranged to produce an output signal in response to occurrence of a certain number of such pulses within a certain time interval, so as to reduce false warnings such as may be caused by ultra-violet radiation from other sources (e.g. solar radiation). The electrical signal from the circuit unit 22A, which will be dependent on the level of the radiation received by the sensor, is fed to a threshold unit 24A which produces a HIGH output (of fixed level) only if the incoming signal has such magnitude as indicates that the received radiation is above a predetermined level. The output of the unit 24A is fed to one input of a three-input AND gate 26.

The electrical output of the infra-red sensor 12 is fed through circuit elements 22B and 24B which respectively correspond in general principle to the units 22A and 24A. The HIGH output of unit 24B is therefore produced only if the sensor 12 senses radiation above the predetermined level set by the threshold unit 24B and is fed to the second input of the AND gate 26.

The third input to the AND gate 26 is received on a line 27. The circuit units feeding this line will be described below. For the time being, however, it will be assumed that line 27 is at a HIGH level.

The output of the AND gate 26 is fed to a suppressor actuating unit 30. When operated by a signal from the output of the AND gate, the unit 30 produces output signals on lines 32 which are connected to the suppressor units 14 (FIG. 1) and cause them to discharge their suppressant into the hangar.

It will therefore be apparent that simultaneous receipt by the sensors 10 and 12 of radiation of the particular type to which they are responsive and which is above the respective thresholds set by the threshold units 24A and 24B will cause AND gate 26 to produce an output signal; this output signal will result in the suppressor units 14 discharging suppressant into the interior of the hangar.

The sensors 10 and 12 are this so selected that their simultaneous detection of sufficient amounts of the particular radiation to which they are responsive is indicative of a fire or explosion to be suppressed. It is also of course important to minimise the chances of false alarms—in response to extraneous sources of electromagnetic radiation whch may arise within the hangar. Thus, the sensors are selected so that the chances are minimised that they will both simultaneously receive sufficient amounts of radiation to produce an alarm in response to such extraneous sources of radiation as solar radiation, lighting within the hangar, hot surfaces, and the like.

As explained, however, the hangar is used to house jet aircraft and it is necessary to take additional precautions to prevent false alarms because of this: specifically, it is necessary to guard against false alarms which might arise if the engines of the aircraft are run while within the hangar and especially if they are run temporarily in the "re-heat" mode. Running jet engines, and particularly engines running in the re-heat mode, may emit such electromagnetic radiation as will result in both sensors 10 and 12 detecting sufficient radiation to operate the suppressor units 14. In order to protect against this, a transducer 34 (see FIG. 1) is mounted within the hangar for sensing when a jet engine is being run up within the hangar and particularly when it is being run in the re-heat mode. The transducer may be of any particular type suitable for detecting a characteristic of a jet engine being run up, particular in the re-heat mode. Advantageously, it is responsive to the acoustic or vibrational energy produced by a jet engine under such conditions, and produces a corresponding electrical signal in response to such energy. As shown in FIG. 2, the transducer 34 has its output connected to a processing unit 36. This may be tuned to a particular frequency response which has been predetermined to correspond to the frequency spectrum of the acoustic or vibrational energy produced by the jet engine under these conditions. The processing unit 36 thus produces an output signal on a line 38 when a jet engine is detected as being run up within the hangar and particularly when it is being run up in the re-heat mode. This electrical signal is fed to a timing unit 40 and thence to an inverter 42. Therefore, when the transducer 34 detects a jet engine being run up and particularly being run up in the re-heat mode the result is that the inverter 42 switches the line 27 from a HIGH level to the LOW level. The AND gate 26 is thus switched off. Therefore, even though the sensors 10 and 12 may produce HIGH inputs to the AND gate 26 (as a result of detecting the radiation from the running jet engine), this will not actuate the suppression units 14.

When the jet engine ceases running, or ceases running in the re-heat mode, the transducer 34 no longer produces the previous output, and inverter 42 thus switches line 27 back to the HIGH level. The system is thus ready to operate normally in the manner already explained.

The purpose of the timing unit 40 is to provide a slight time delay before the inverter 42 switches line 27 back to the HIGH level. This is to allow time for the previously running jet engine to cool down sufficiently to prevent its continuing to emit radiation which might give false alarms.

Figure 3:
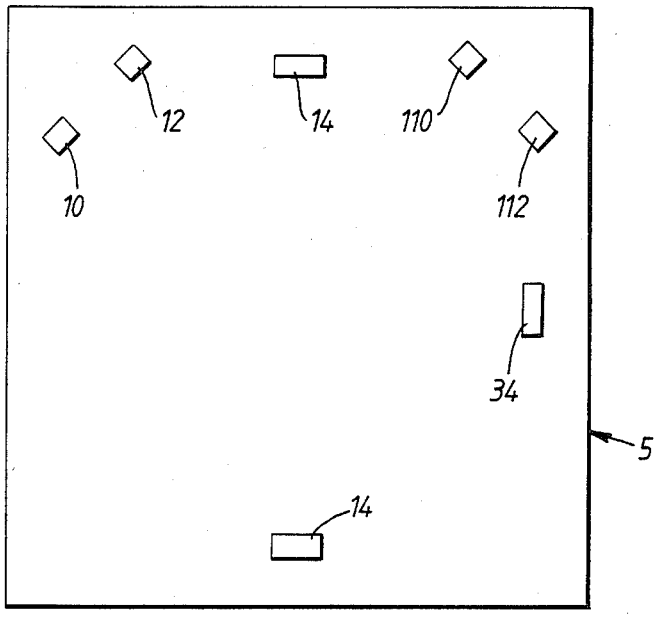
FIG. 3 is a diagrammatic view corresponding to FIG. 1 but showing a modified form of the system.
Figure 4:
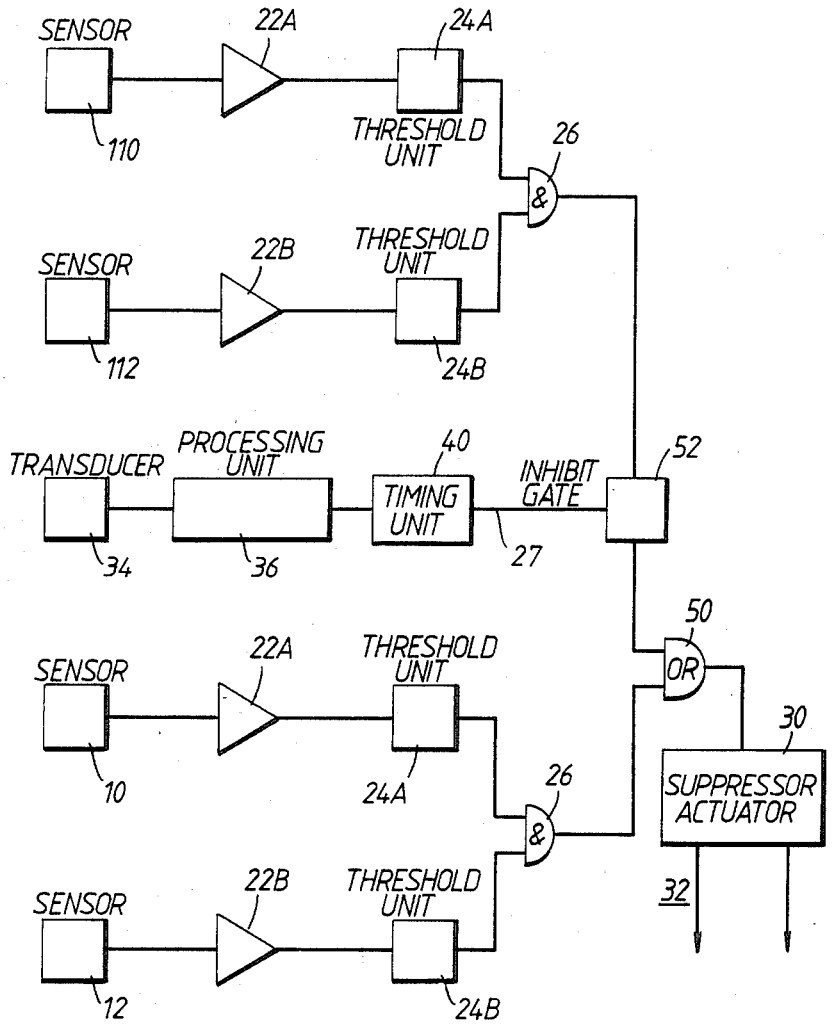
FIG. 4 is a block circuit diagram applicable to the modified form of the system.

FIGS. 3 and 4 illustrate a modified system, and parts in FIGS. 3 and 4 corresponding to those in FIGS. 1 and 2 have the same references as in FIGS. 1 and 2.

As shown in FIG. 3, the hangar in this case is monitored by four radiation sensors, two sensors 10 and 12 corresponding to the sensors 10 and 12 described with reference to FIG. 1 and two further sensors 110 and 112, again respectively corresponding to the sensors 10 and 12 of FIG. 1.

As shown in FIG. 4, the sensors 10 and 12 are connected through similar circuit units to those described with reference to FIG. 2 to an AND gate 26. However, this does not directly feed the suppressor actuating unit 30 but feeds it through an OR gate 50.

The outputs of sensors 110 and 112 are connected through similar circuitry to sensors 10 and 12 to a second AND gate 26. The output of this gate is fed through an inhibit gate 52 to the second input of the OR gate 50.

In FIG. 4, each of the AND gates 26 is a two-input gate in contrast to the AND gate 26 of FIG. 2 which has three inputs). The system of FIGS. 3 and 4 has the transducer 34 corresponding to the transducer 34 of FIG. 1. The output of the transducer 34 is fed through a processing unit 36 and a timing unit 40, corresponding to units 36 and 40 of FIG. 2, to control the inhibit gate 52.

It will initially be assumed that there is no jet engine being run up, or being run up in the re-heat mode, within the hangar. The transducer 34 is therefore not producing any output. Under these conditions, the inhibit gate 52 is in the non-blocking state.

Under these conditions, therefore, simultaneous receipt by the sensors 10 and 12 of sufficient amounts of the radiation to which they are responsive will result in their AND gate 26 producing an output which will cause the suppressor units 14 to be actuated via the OR gate 50. Similarly, simultaneous detection by the sensors 110 and 112 of sufficient amounts of the radiation to which they are responsive will result in their AND gate 26 setting off the suppressor units 14 via the OR gate 50. In other words, either pair of sensors can detect fires or explosions of the type to be suppressed and can set off the suppressor units 14. Such an arrangement enables a larger area of hangar to be monitored.

However, it is assumed, in the system of FIGS. 3 and 4, that the jet engines of aircraft are only likely to be run up, or run up in the re-heat mode, in a particular area of the hangar which is closer to the sensors 110 and 112 than to the sensors 10 and 12. Therefore, electromagnetic radiation emitted by such a running jet engine is only likely to cause the sensors 110 and 112 to produce a false alarm. Thus, when the transducer 34 detects the presence of such acoustic or vibrational energy as corresponds to a running jet engine and particularly a jet engine running in the re-heat mode, it switches the inhibit gate 52 (FIG. 4) into the blocking mode. The sensors 110 and 112 can therefore no longer operate the suppressor units 14 (for so long as the transducer 34 is producing the appropriate output and for the additional time thereafter governed by the timing unit 40). However, although the sensors 110 and 112 are effectively switched off, the sensors 10 and 12 can still operate normally.

The system of FIGS. 3 and 4 therefore enables at least a partial monitoring of possible fires and explosions to be continued while sensors 110 and 112 are effectively disabled.

Various modifications may be made to the systems. For example, instead of one pair of sensors (as in FIG. 1) or two such pairs (as in FIG. 3), there may be several such pairs connected to a logic circuit which carries out a "voting" process to determine whether to fire the suppressor units 14, that is, it requires a predetermined number of HIGH signals, and from a predetermined selection of the sensors, before it fires the suppressor units 14. In such a system, the transducer 34 would again be provided to block firing of the suppressor units in the event of a jet engine being run up.

What is claimed is:

1. A fire and explosion detection system for detecting fire or explosion within an area to be protected, comprising radiation detection means operative to produce an alarm signal in response to the detection of electromagnetic radiation from a source within the said area and thereby indicative of a fire or explosion in the said area, non-radiation-responsive transducer means operative to detect the existence within the said area of a predetermined non-radiation parameter and thereby indicating that the source of electromagnetic radiation to which the radiation detection means is responsive is one in response to which no alarm signal is required, and inhibit means responsive to the non-radiation-responsive transducer means for blocking such alarm signal.

2. A system according to claim 1, in which the radiation detection means comprises a plurality of radiation sensors each producing a respective output signal in response to detection of predetermined radiation, and including circuit means responsive to the outputs of the radiation sensors to produce the said alarm signal.

3. A system according to claim 2, in which the circuit means includes a coincidence gate for producing the said alarm signal in response to simultaneous receipt of the output signals from the radiation sensors, and the inhibit means comprises means for blocking such response of the coincidence gate.

4. A system according to claim 2, in which the circuit means comprises logic means for producing the said alarm signal in response to simultaneous receipt of the output signals from a predetermined selection of the radiation sensors, and the inhibit means comprises means for blocking such response of the logic means.

5. A system according to claim 1, in which the said source of electromagnetic radiation which is required not to produce an alarm signal is a running jet engine of a jet aircraft.

6. A system according to claim 5, in which the predetermined non-radiation parameter to which the non-radiation-responsive transducer means is responsive is the acoustic or vibrational energy emitted by the running jet engine.

7. A fire and explosion detection and suppression system, for protecting an area in which jet aircraft may be stored, comprising radiation detection means for detecting electromagnetic radiation arising from such fires and explosions within the said area and for producing a respective alarm signal, suppression means within the area and responsive to the alarm signal to discharge fire and explosion suppressant into the area, and transducer means responsive to the acoustic or vibrational energy emitted by a running jet engine for inhibiting the production of the said alarm signal.

8. A system according to claim 7, in which there are a plurality of such radiation detection means each capable of producing a said alarm signal, and the non-radiation-responsive transducer means is connected to block the production of the alarm signal by at least one but not all of the said radiation detection means.

9. A system according to claim 7, in which the radiation detection means comprises a plurality of radiation sensors each producing a respective electrical output in response to receipt of radiation of a predetermined type, and including respective circuit means connected to receive the outputs from each plurality of sensors and to produce the said alarm signal in response thereto.

10. A fire and explosion detection and suppression method, for protecting an area in which jet aircraft may be stored, comprising the steps of detecting electromagnetic radiation arising from such fires and explosions within the said area and for producing a respective alarm signal.

responding to the said alarm signal by discharging fire and explosion suppressant into the area, and responding to the acoustic or vibrational energy emitted from a running jet engine by inhibiting the production of the said alarm signal.

* * * * *